United States Patent [19]

Cooper

[11] Patent Number: 4,765,619

[45] Date of Patent: Aug. 23, 1988

[54] TABLE TENNIS APPARATUS

[76] Inventor: Willam A. Cooper, 276 Placid Cove Dr., New Braunfels, Tex. 78130

[21] Appl. No.: 853,417

[22] Filed: Apr. 17, 1986

[51] Int. Cl.[4] ..... A63B 39/00

[52] U.S. Cl. ..... 273/30; 273/67 R

[58] Field of Search ..... 273/30, 309, 285, 76, 273/67 R, 67 B; 108/59, 64, 65, 86, 87, 99, 112, 115, 69, 1-9, DIG. 3, DIG. 4, DIG. 5

[56] References Cited

U.S. PATENT DOCUMENTS

| | | | |
|---|---|---|---|
| 199,247 | 9/1864 | Cordier | 273/76 |
| 454,700 | 6/1891 | Barker | 273/76 |
| 2,313,701 | 3/1943 | White | 273/30 |
| 2,614,839 | 10/1952 | Forsyth . | |
| 2,665,908 | 1/1954 | Gray . | |
| 2,936,896 | 5/1960 | Friedman | 108/1 |
| 2,987,316 | 6/1961 | Butera | 273/76 |
| 3,172,664 | 3/1965 | Lohr et al. . | |
| 3,622,156 | 11/1971 | Pugsley . | |
| 3,655,187 | 4/1972 | Pugsley | 108/64 |
| 3,942,795 | 3/1976 | Psenka . | |
| 4,217,832 | 8/1980 | Pozzan | 108/64 |
| 4,307,882 | 12/1981 | Hay et al. . | |

FOREIGN PATENT DOCUMENTS

| | | | |
|---|---|---|---|
| 909812 | 9/1972 | Canada | 273/67 R |
| 2135048 | 2/1973 | Fed. Rep. of Germany | 273/67 R |
| 28855 | 5/1974 | Fed. Rep. of Germany | 273/76 |

*Primary Examiner*—Richard C. Pinkham
*Assistant Examiner*—T. Brown
*Attorney, Agent, or Firm*—Fleit, Jacobson, Cohn & Price

[57] ABSTRACT

A compact table tennis-type apparatus is provided including a pair of tabletops placed horizontally apart and inclined downwardly toward each other. Support structure is provided for mounting the tabletops in stationary position relative to each other and the support structure may include a first form for partial support from a card table or the like and partial support from the floor upon which the card table rests or a second form operative to support the tabletops solely from an associated card table. In addition, paddle structures including handgrips which substantially require the paddles to be used by a game player in a "punching" manner are provided and one form of the disclosed apparatus utilizes tabletops which may be removably hingedly connected together in order to form a hollow carrying case.

14 Claims, 2 Drawing Sheets

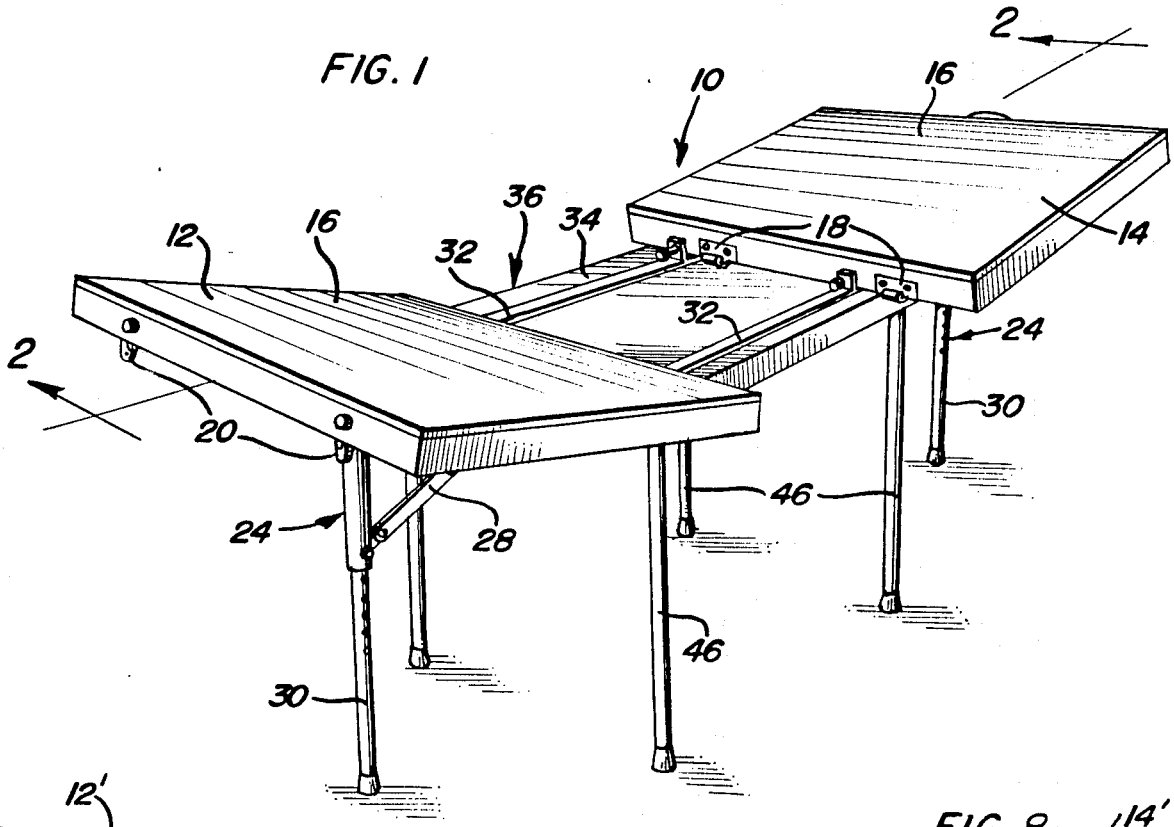
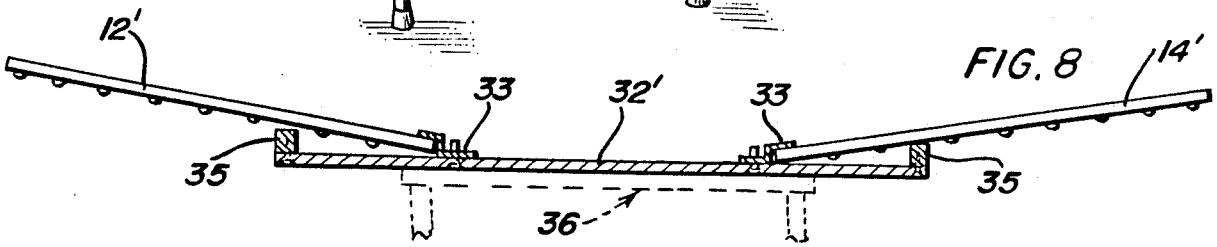
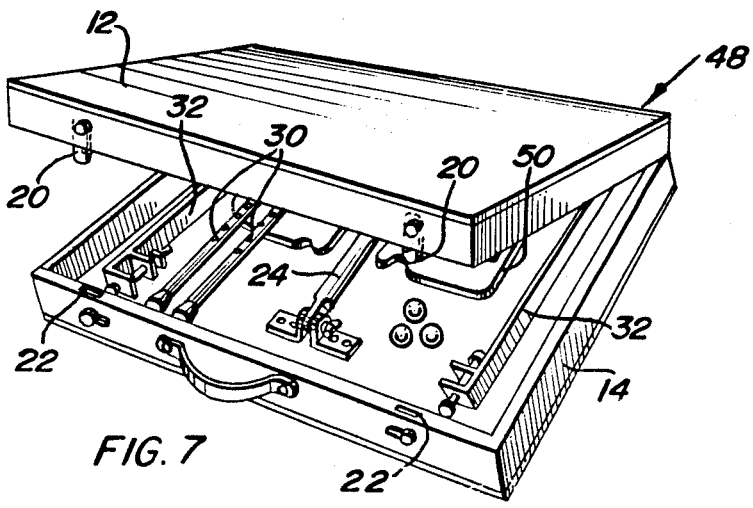
FIG. 7
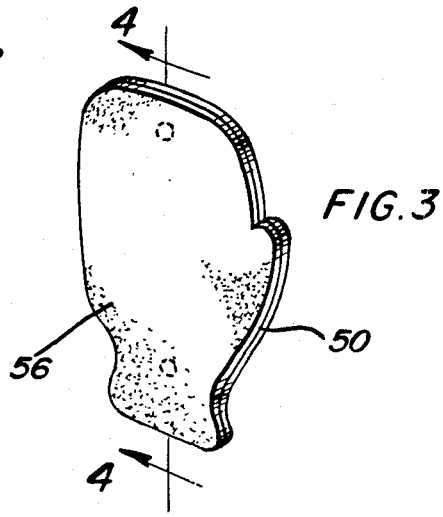

TABLE TENNIS APPARATUS

BACKGROUND OF THE INVENTION

1. Field of the Invention

This invention relates to a table tennis-type game apparatus incorporating a pair of horizontally spaced apart generally planar tabletop sections inclined downwardly toward each other and to be used in connection with a table tennis ball or the like and suitable paddles in a ball-paddle game similar to table tennis but not including a net. The incline of the tabletops causes the game ball to bounce along a higher trajectory in order to shorten the length of the playing area to be occupied. The tabletops, in one disclosed form of the invention, comprise halves of a carrying case releasably joined together to provide storage space for the game paddles, the ball and the support structure by which the tabletops are supported relative to each other for game play. The paddles to be used in playing the game include front sides for striking the game ball and rear sides along which elongated support handles extend in slightly spaced relation relative to the paddles. The space between the rear sides of the paddles and the handles is slightly greater than the thickness of the base end of an adult's forefinger.

2. Description of Related Art

Various different forms of paddle-ball games incorporating a playing table heretofore have been provided including table tennis and various modifications thereof such as those disclosed in U.S. Pat. Nos. 454,700, 2,614,839, 2,665,908, 3,172,664, 3,622,156, 3,942,795 and 4,307,882. However, these ball-paddle games usually require a game area of considerable length and width and the game of the instant invention therefore utilizes tabletop sections which are inclined upwardly away from each other to increase the height of the trajectory of the game ball and thus reduce the length of the required area in which to play the game.

SUMMARY OF THE INVENTION

This invention constitutes a table tennis-type of paddle-ball game including table structure which greatly reduces the length of the required game area and utilizes fist supported paddles for striking a gas ball which may be in the form of a table tennis ball. The reduced length of the required game area as established by the table construction is further reduced through the utilization of fist supported paddles, inasmuch as this type of paddle greatly reduces the ability of a game player to strike swiftly at the game ball.

The main object of this invention is to provide a table tennis-type of paddle ball game wherein modifications of conventional table tennis, table and paddle structures are incorporated and coact with each other to greatly reduce the length of the required game area.

Another object of this invention is to provide game apparatus in accordance with the preceding object and wherein the required width of the game area is also substantially reduced.

Yet another important object of this invention is to provide a game apparatus of the table tennis-type which may be readily broken down into a small dimension game case configuration for each in transport and storage.

A further object of this invention is to provide a game apparatus of the table tennis-type and incorporating ball paddles equipped with handles which appreciably restrict the ability of a game player to return a game ball at high speeds.

Another object of this invention is to provide a modified form of table tennis game requiring game playing skills which are generally similar to and specifically different from those required to play conventional table tennis.

A final object of this invention to be specifically enumerated herein is to provide a table tennis-type of game in accordance with the preceding objects and which will conform to conventional forms of manufacture, be of simply construction and amusing to play so as to provide a game which will be economically feasible, long lasting and entertaining.

BRIEF DESCRIPTION OF THE DRAWINGS

FIG. 1 is a perspective view of a first form of table tennis apparatus constructed in accordance with the present invention and operatively associated with a supportive card table;

FIG. 3 is a perspective view of one of the paddles used in the apparatus of the instant invention;

FIG. 7 is a perspective view of the apparatus illustrated in FIGS. 1–6 in a dismantled form and with the tabletop sections hindedly joined together to form a carrying case illustrated in a partially open position; and FIG. 8 is a vertical sectional view similar to FIG. 2 illustrating a modified form of table tennis apparatus.

DESCRIPTION OF THE PREFERRED EMBODIMENTS

Figure 2:
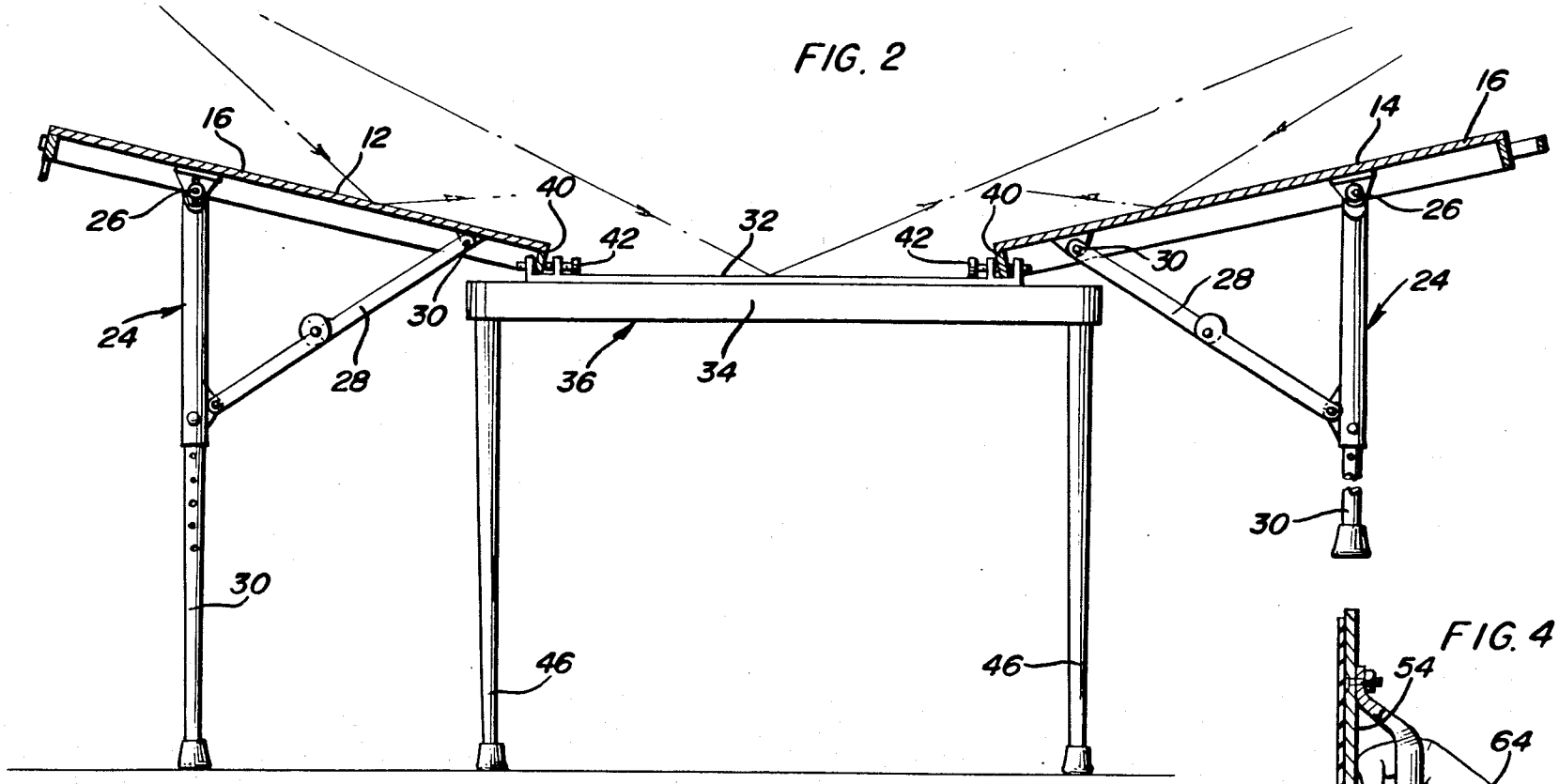
FIG. 2 is an enlarged fragmentary vertical sectional view taken substantially upon the plane indicated by the section line 2—2 of FIG. 1.
Figure 4:
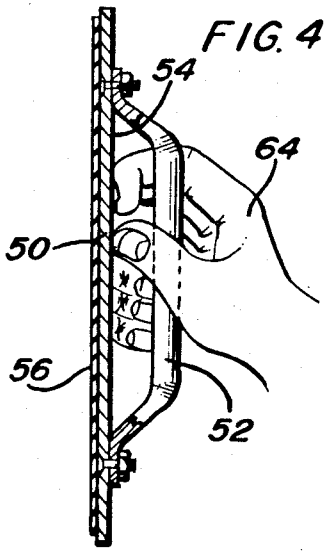
FIG. 4 is an enlarged vertical sectional view taken substantially upon the plane indicated by the section line 4—4 of FIG. 3.
Figure 6:
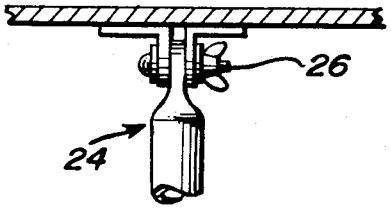
FIG. 6 is an enlarged fragmentary vertical sectional view illustrating the manner in which one of the tabletop legs is hingedly supported from the corresponding tabletop.

Referring now more specifically to the drawings, the numeral 10 generally designates the table tennis apparatus of the instant invention. The apparatus 10 includes a pair of table or housing sections 12 and 14 including substantially planar upwardly facing upper surfaces 16. Each of the sections 12 and 14 is generally 26 inches by 36 inches and comprises a hollow housing half open on one side. One pair of corresponding sides of the housing sections 12 and 14 include coacting releasable hinge assemblies 18 while the corresponding opposite sides of the housing sections 12 and 14 include coacting releasable latch structures 20 and 22 whereby the housing sections 11 and 14 may be removably hingedly secured together and releasably latched in closed positions.

Each of the housing sections 12 and 14 has a leg assembly referred to in general by the reference numeral 24 removably pivotally secured thereto as at 26. Each leg assembly 24 includes a collapsible brace 28 pivotally connected to the corresponding housing section as at 30 and each leg assembly 24 includes an adjustably extendible and removable lower end section 30.

Figure 5:
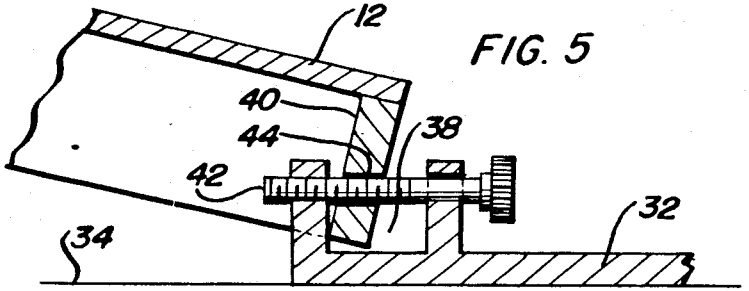
FIG. 5 is an enlarged fragmentary vertical sectional view illustrating the manner in which the table sections of the apparatus may be stationarily positioned relative to each other and a supportive card table.

With attention now invited more specifically to FIGS. 1, 2, 5 and 7 of the drawings, it may be seen that the apparatus 10 includes a pair of elongated mounting bars 32 which may rest upon the horizontal top or upper surface 34 of a card table referred to in general by the reference numeral 36. The opposite ends of the mounting bars 32 define upwardly opening channels 38 in which to receive longitudinally spaced portions of the sidewalls 40 of the table sections 12 and 14 from which the hinge assemblies 18 are supported. Each of the channels 38 removably threadedly mounts a transverse lock pin 42 therefrom and each pin 42 is passed through a bore 44 formed in the corresponding sidewall 40. Thus, the table sections 12 and 14 are mounted from the card table 36 in stationary position relative to each other through the utilization of the mounting bars 32. The leg assemblies 24 are adjustable according to the height of the card table 34 and support the remote marginal sides of the table sections 12 and 14 from the same supports surface 44 from which the lower ends of the legs 46 of the card table 36 rest.

The extendible and removable lower end sections 30 of the leg assemblies 24 may be removed and received within the carrying case referred to in general by the reference numeral 48 defined when the two housing sections 12 and 14 are removably hinged together. In addition, the mounting bars 32 are less than 26 inches long and are removably receivable within the carrying case 48 along with the lower end sections 30 and at least one pair of paddles 50 and a plurality of game balls 52.

The paddles 50 are of a plan shape generally corresponding to the outline of a person's hand and each paddle 50 includes an elongated handgrip 52 extending lengthwise along the rear side 54 of the paddle 50 in spaced relation relative thereto. The front side of each paddle 50 may include a suitable rough cover panel 56. The handgrips 52 are spaced from the rear sides 54 of the paddles 50 a distance slightly greater than the front-to-rear thickness of a adult's forefinger between the knuckle and the first joint thereof. Accordingly, a player, when gripping a handgrip 52 of a paddle 50 with his hand 60, grips the handgrip 52 with his hand in the form of a fist. This type of grip on the handgrip 52 substantially requires that a player of the game "punch" at a game ball with his or her paddle 50 rather than swinging at the game ball with his or her paddle.

The table sections 12 and 14 are horizontally spaced apart and inclined downwardly toward each other approximately 12 degrees relative to the horizontal. Furthermore, there is no net between the table sections 12 and 14. The inclination of the table sections 12 and 14 causes a game ball 52 to rebound from either table section 12 or 14 along a higher trajectory and thus requires a player of the game to return the game ball 52 down toward the opponent's table section at a steeper incline. The steep incline return of a ball 52 to an opponent's top section results in an even higher trajectory rebound of the game ball from that table section. Thus, after the initial serve the game ball 52 rebounds at a considerably higher trajectory than a conventional table tennis ball and results in a game being played with the apparatus 10 requiring not only a considerably shortened game area but also a considerably narrower game area. Furthermore, the apparatus 10 may be conveniently disassembled and transformed into the relatively small carrying case 48.

With attention now invited more specifically to FIG. 8, there may be seen a modified form of apparatus referred to in general by the reference numeral 10' and including table sections 12' and 14' corresponding to the sections 12 and 14, but which do not comprise housing halves. In addition, rather than utilizing mounting bars corresponding to the mounting bars 32, a pair of elongated mounting bars 32' are provided which are longer in length than the mounting bars 32 and include hold-down clamps 33 for the adjacent edges of the top sections 12' and 14'. The mounting bars 32 extend rearward beneath the top sections 12' and 14' and include upwardly projecting abutments 35 against which the under surfaces of the table sections 12' and 14' abut and the mounting bars 32' may rest upon the card table 36 and comprise the sole support of the table sections 12' and 14' relative to each other. In this manner, the apparatus 10' may be manufactured and marketed at a lower cost than the apparatus 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an upwardly facing generally horizontal support surface, a table tennis apparatus, said apparatus including a pair of substantially planar horizontally spaced apart inclined table sections, said sections having substantially planar upwardly facing inclined upper surfaces, support means on said horizontal support surface for releasably attaching and supporting said table sections relative to each other in said horizontally spaced apart relation said inclined upper surfaces being equally and oppositely downwardly inclined toward each other at a shallow angle relative to said horizontal support surface such that a game ball hit downwardly at a shallow angle relative to said horizontal support surface from an elevation above said inclined upper surfaces and toward one of said inclined upper surfaces from above the other of said inclined upper surfaces and impacting with said one inclined upper surface will rebound upwardly from and over said one inclined upper surface and in the same general flight direction at a greater angle relative to said horizontal support surface than if said ball had impacted with said horizontal support surface at the same shallow angle.

2. The table of claim 1 wherein said table sections each being inclined generally 12 degrees relative to the horizontal.

3. The table of claim 1 wherein said table sections are spaced apart a distance slightly less than the width of said table sections measured along a path extending between said table sections.

4. The table of claim 1 including at least one pair of ball paddles, said paddles each including opposite sides with one of said sides comprising a ball impacting side, each of the other sides of said paddles including an elongated handgrip extending thereacross in spaced relation relative thereto.

5. The table of claim 4 wherein the spacing between said elongated handgrips and the opposing sides of said paddles is slightly greater than the front-to-rear thickness of an adult first finger segment between the first joint thereof and the associated knuckle.

6. The table of claim 1 wherein said support means comprises a pair of mounting bars extending between said table sections and from which adjacent marginal portions of said table sections are supported against shifting relative to each other.

7. The table of claim 6 wherein said mounting bars comprise the sole means for supporting said table sections in stationary position relative to each other.

8. A table for use in a table paddle ball game, said table including a pair of horizontally spaced table sections including substantially planar upwardly facing inclined upper surfaces, support means extending between and releasably supporting said table sections relative to each other in horizontally spaced apart relation and with said upper surfaces equally and oppositely downwardly inclined toward each other, said table sections comprising hollow open sided carrying case halves including a first pair of corresponding marginal portions equipped with releasably engageable hinge means and a second pair of corresponding marginal portions opposite said first marginal portions equipped with coacting releasably engageable latch means for securing said halves together with said planar surfaces outermost and facing in opposite directions.

9. The table of claim 8 including at least one pair of ball paddles receivable between said halves and within the confines thereof when said halves are secured together by said hinge means and latch means.

10. The table of claim 4 wherein said support means comprises a pair of mounting bars extending between said table sections and from which adjacent marginal portions of said table sections are supported against shifting relative to each other, said support means also being receivable between sand within the confines of said halves.

11. The table of claim 9 wherein said paddles each include opposite sides with one of said sides comprising a ball impacting side, each of the other sides of said paddles including an elongated handgrip extending thereacross in spaced relation relative thereto.

12. The table of claim 11 wherein the spacing between said elongated handgrips and the opposing sides of the corresponding paddles is slightly greater than the front-to-rear thickness of an adult's first finger segment between the first joint thereof and the associated knuckle.

13. The table of claim 8 wherein said support means comprises a pair of mounting bars extending between said table sections and from which adjacent marginal portions of said table sections are supported against shifting relative to each other, said support means being receivable between and within the confines of said halves.

14. The table of claim 13 wherein said support means also includes foldable and extendible leg means carried by each of said table sections.

* * * * *